US007159527B2

(12) United States Patent
Nielsen

(10) Patent No.: US 7,159,527 B2
(45) Date of Patent: Jan. 9, 2007

(54) MOORING OF A FLOATING UNIT TO A VESSEL SIDE

(75) Inventor: Peter Brinch Nielsen, Esbjerg (DK)

(73) Assignee: Viking Life-Saving Equipment A/S, Esbjerg (DK)

( * ) Notice: Subject to any disclaimer, the term of this patent is extended or adjusted under 35 U.S.C. 154(b) by 93 days.

(21) Appl. No.: 10/509,879

(22) PCT Filed: Oct. 9, 2002

(86) PCT No.: PCT/DK02/00678

§ 371 (c)(1),
(2), (4) Date: Oct. 4, 2004

(87) PCT Pub. No.: WO03/018396

PCT Pub. Date: Mar. 6, 2003

(65) Prior Publication Data

US 2005/0166829 A1 Aug. 4, 2005

(30) Foreign Application Priority Data

Apr. 4, 2002 (DK) ..... 2002 00498

(51) Int. Cl.
*B63C 9/22* (2006.01)
*A62B 1/20* (2006.01)

(52) U.S. Cl. ..... 114/230.2; 114/230.24; 114/375; 114/376

(58) Field of Classification Search ..... 114/230.1, 114/230.2, 230.22, 230.23, 230.24, 230.25, 114/230.27, 248–252, 293, 348, 375, 376, 114/377; 440/3–5
See application file for complete search history.

(56) References Cited

U.S. PATENT DOCUMENTS 3,004,391 A * 10/1961 Miller ..... 405/219
3,788,258 A * 1/1974 Odom ..... 114/230.24
4,260,293 A * 4/1981 Peterson ..... 405/219

(Continued)

FOREIGN PATENT DOCUMENTS

DK 163725 B 3/1992

(Continued)

OTHER PUBLICATIONS

International Search Report for International Application No. PCT/DK02/00678.

*Primary Examiner*—Ajay Vasudeva
(74) *Attorney, Agent, or Firm*—Finnegan, Henderson, Farabow, Garrett & Dunner LLP

(57) ABSTRACT

A mooring system (28) of a floatable unit (20), such as life raft or platform, the floatable unit (20) having a first side (21) facing a vessel side (22) and a second side (23) facing away from the vessel side (22). The mooring system (28) comprises at least two back springs (2) which are in connection with the first side (21) of the floatable unit (20), and at least one strap (1) which is in connection with the second side (23) of the floatable unit (20), the back springs (2) and the strap (1) being connected to the vessel (30). The back springs (2) are adapted to control the floatable unit (20) in a longitudinal direction in relation to the vessel (30), and the strap (1) is adapted to control the floatable unit (20) in a transverse direction in relation to the vessel (30). The floatable unit is held in secure and fixed position alongside the vessel side, thereby enabling people evacuating from the vessel to enter the floatable unit without any high risk of injury or damage.

14 Claims, 7 Drawing Sheets

U.S. PATENT DOCUMENTS 4,656,961 A * 4/1987 Hellkamp ..... 114/230.18
4,864,956 A * 9/1989 Onstwedder, Jr. ..... 114/230.24
5,832,861 A 11/1998 Taylor

FOREIGN PATENT DOCUMENTS

GB 2105264 A 3/1983
GB 2268711 A 1/1994
GB 2 338 931 A 1/2000
WO WO 95/35233 12/1995

* cited by examiner

MOORING OF A FLOATING UNIT TO A VESSEL SIDE

This is a 35 U.S.C. 371 application of PCT/DK02/00678, filed on Oct. 9, 2002, which claims the benefit of priority to Danish Application No. PA 2002-00498 filed Apr. 4, 2002, each of which being incorporated by reference herein.

FIELD OF THE INVENTION

The present invention relates to a floatable unit, such as liferaft or platform, having a first side facing a vessel side and a second side facing away from the vessel side, said floatable unit comprising a mooring system.

The invention also relates to a mooring system for floatable units.

The term vessel is in this context to be construed as being a marine installation, such as vessel, ship, boat or offshore installation.

BACKGROUND ART

Floatable units, such as liferafts or platforms are often used in the evacuation of the passengers or crew members from a vessel.

Heeling movements as well as the movements which are caused by the loads such as wind, current or waves, exerted on the vessel render that the position as well as the movements of the vessel are changing all the time. Furthermore, due to the fact that the floatable unit is smaller in size than the vessel the floatable unit moves more rapidly than the vessel.

These movements of the vessel, as well as of the floatable unit are causing the difficulties of entering the floatable unit from the vessel, as the distance, both in height, in the transverse as well as in the longitudinal, direction between the vessel and the floatable unit is varying constantly, whereby it is almost impossible to hold the floatable unit in a secure and fixed position in relation to the vessel.

Often the evacuation of the persons from the vessel takes place during heavy weather, which furthermore influences as well as exerts great forces and loads on the vessel and the floatable unit.

Furthermore, the deck of the vessel, where the evacuation of the persons takes place from are normally placed above the waterline, and thereby above the floatable unit, and may have many different distances depending on the size of the vessel.

The evacuation from the vessel into the floatable unit may be carried out by means of many different arrangements, typically a slide or a chute. More and more often the so called chute is used. The reason for this is that the chute as a vertical escape route is arranged to absorb the vertical variation of the distance between the evacuation point on the vessel and the floatable unit.

If there is a large vertical distance between the deck of the vessel and the floatable unit, and if this distance vary frequently during the evacuation, the chute, in it self is able to absorb this varying distance, due to its length and its thereby build-in flexibility.

However, in the cases where the distance between the deck of the vessel and the floatable unit is limited, a shorter chute might be used. In this case, the longitudinal displacement of the raft in relation to the vessel, will cause the chute to be inclined to such an extent that the chute becomes occasionally unusable.

The above-mentioned drawbacks and disadvantages are primarily explained in connection with the vertical distance. However, similar drawbacks and disadvantages occur in relation to the transverse and longitudinal distances between the evacuation point of the vessel and the floatable unit.

Some known mooring systems consist of two lines which extends from a winch placed on the deck of the vessel and down to separate guiding points, placed on the vessel side above the waterline and towards the liferaft. The turning points are placed in a mutual distance larger than the length of the inflatable raft. The lines are fixed at each corner of the liferaft by means of a glued or welded attachment arrangement.

The known mooring systems have the disadvantage that when the liferafts shall be pulled into the vessel side to evacuate passengers down in the raft great pulling forces have to be used, which affect the area where the lines are fixed. Whereby the raft is easily destroyed in the area around the fixed point for the mooring lines.

The pulling forces in the fixed point for the line are increased further when the vessel and the raft are placed differently in relation to wave trough and wave crest.

SUMMARY OF THE INVENTION

An object of the present invention is to wholly or partially overcome the above disadvantages of the prior art. More specifically, it is an object to provide a floatable unit, which can be securely positioned alongside a vessel during evacuation of passengers or crew members.

It is furthermore an object of the invention to provide a mooring system for a floatable unit, which system in expedient manner is adapted to control the longitudinal as well as the transverse movements of the floatable unit in relation to a vessel.

The above objects, together with numerous other objects, advantages and features which will become evident from the below description, are accomplished by a solution in accordance with the present invention by the mooring system comprising at least two back springs which are in connection with the first side of the floatable unit, said springs being adapted to control the floatable unit in a longitudinal direction in relation to the vessel. The system furthermore comprises at least one strap, which is in connection with the second side of the floatable unit, said strap being adapted to control the floatable unit in a transverse direction in relation to the vessel, and said back springs and said strap being connected to the vessel.

The new system has the advantage, that the forces on the raft are distributed over a larger area and that it is easier to control the raft in relation to either the movements, which emanates from the vessel or the longitudinal movements, which are caused by the difference of height between wave crest and wave trough as well as the movements, which are caused by current and wind load.

Furthermore by having the floatable unit in expedient manner held in the secure and fixed position alongside the vessel side it is obtained that the people, who are going to be evacuated from the vessel, are able to enter the floatable unit without any high risk for personnel damage. Additionally, the secure and fixed position of the floatable unit makes it more pleasant for the people to stay and work in the floatable unit during the mooring to the vessel, due to the fact that the movements of the floatable unit are controlled to a minimum.

It should however be mentioned that the heavy weather conditions such as strong wind, high wave height and strong current makes conditions almost inhuman, as the floatable unit will have large and uncomfortable movements relating to the vessel. However, the solution according to the invention is minimising the above mentioned movements of the floatable unit which have been surprising for the skilled person.

A further advantage by the solution of the present invention is that the system may be used with both short and long evacuation means, as the floatable unit is held in a fixed secure position.

During operation of the floatable unit wherein it is moored to the vessel side, the back springs, which are in connection with the side of the floatable unit facing the vessel, secure that the floatable unit is controlled in the longitudinal direction in relation to the vessel. The back springs extend, as will be appreciated by a skilled person, from the first side of the floatable unit alongside the side towards the vessel, so that the back springs substantially extend parallel in relation to sides of the floatable unit and the vessel. Hereby, the back springs will control the mutual longitudinal movements of the floatable unit and the vessel, so that the floatable unit is essentially held in a fixed position in the longitudinal direction in relation to the vessel. Both of the back springs extend from the side of the floatable unit outward past the ends of the floatable towards the vessel.

Furthermore, the strap extends from the second side of the floatable unit, which side is facing away from the vessel, towards the vessel. Hereby the strap is secured under operation that the floatable unit is controlled in the transverse direction in relation to the vessel. The strap extends essentially perpendicular from the vessel towards the second side of the floatable unit. The strap furthermore extends from the second side of the floatable unit past both ends of the floatable unit towards the vessel in order to hold the floatable unit in a secure and fixed position.

The term back spring is in this context to be construed as being a rope, strap, belt or wire. The back springs may be produced of an arbitrary material, which has sufficient strength for holding the raft. The back springs are in a preferred embodiment produced of strong woven material.

The term strap is in this context to be construed as being a rope, belt or wire. The strap may be produced by an arbitrary material, which has sufficient strength for keeping the raft towards the vessel side.

In an expedient embodiment according to the invention the mooring system may comprise at least two mooring lines which are in connection with the strap and the back springs, respectively, said mooring lines being connected to the vessel. According to the invention, a plurality of mooring lines may be arranged between the vessel and the floatable unit. In a preferred embodiment two mooring lines are arranged, whereby it is obtained, that only one mooring line at each end of the floatable unit is connected to the vessel, whereby an easier handling of the mooring system is also obtained.

Advantageously according to the invention there may be arranged at least one flexible element between the mooring lines and the strap and/or between the mooring lines and the back springs. Thus it is obtained that the flexible element is taking up or absorbing the tensile stresses in the back springs, strap or mooring lines which are caused by the mutual movements between the floatable unit and the vessel. A further advantage is that strong pulls in the back springs, strap or mooring lines are avoided and thereby the back springs, strap or mooring lines may be maintained at a considerably lower level of tension. The fact is that the movements of the floatable unit in relation to the vessel is almost eliminated by this system.

The term flexible element is in this context to be construed as being an element arranged for absorbing tensile stresses in the mooring system and may for instance be made of an elastic material, be an elastic or rubber rope or be a spring.

Further according to the invention a flexible element may be arranged at the ends of the back springs and/or at the ends of the strap facing the vessel, whereby each element in the system can absorb the forces exerted on them.

In a preferred embodiment according to the invention the strap maybe lead alongside the second side, so as to provide an encircling of the floatable unit, and each end of the strap is connected to the vessel. By this encircling of the floatable unit by the strap a secure way to hold the floatable unit in a fixed position obtained. Furthermore, the pulling forces exerted on the strap, which in the known floatable units are absorbed by the attachments onto which the strap is fixed, may be absorbed by the entire second side of the floatable unit. The fact is that the exerted forces absorbed by the strap are pushing the floatable unit against the vessel, rather than as the prior art pulling the strap away from the floatable unit, with the result of damaging the attachment.

According to the present invention the mooring system comprises two straps, in which one end of the straps are fixed to the second side of the floatable unit and the other end of the straps are connected to the vessel.

According to a preferred embodiment according to the present invention the back springs may be fixed substantially to the centre of the first side and extend outward towards the vessel. By this fixation of the back springs it is obtained that the back springs substantially extends parallel in relation to the sides of the floatable unit and the vessel.

Advantageously the strap according to the invention may be held in position on the second side by strap attachments, in which the strap is able to move sideways. Hereby it is obtained that the floatable unit is not exerted by any forces from the strap, as the strap in this embodiment is not securely fixed in the attachments. Thus the floatable unit is wrapped or encircled by the strap.

The strap may in an arbitrary way be fixed around the raft, but in a preferred embodiment it is held in position by strap attachments, which are placed on the side of the raft, which is facing away from the vessel side as well as on the two longitudinal sides.

In an expedient embodiment according to the invention the floatable unit may be inflatable, and the floatable unit may comprise at least two inflatable chambers arranged on top of each other. The inflatable floatable unit, such as liferaft or platform, may comprise a peripheral edge having at least one inflatable chamber surrounding a bottom secured in leak tight fashion to the tubular inflatable chambers. Due to security reasons the inflatable floatable unit comprises at least two chambers, whereby if one of the chambers are not functioning, the other will have the necessary buoyancy to keep the floatable unit floating.

According to the invention the strap attachments may be placed so as it extends from the first chamber to the second chamber of the floatable unit.

In a further preferred embodiment the strap attachment is placed so that it extends from a first chamber to a second chamber for distributing the forces between the two chambers and to avoid that the buoyancy chambers are separated.

The present invention furthermore concerns a mooring system for a floatable unit, such as liferaft or platform, said floatable unit having a first side facing a vessel side and a second side facing away from the vessel side. Wherein the mooring system is characterised in that it may comprise at least two back springs which are in connection with the first side of the floatable unit, said springs being adapted to control the floatable unit in a longitudinal direction in relation to the vessel, at least one strap which is in connection with the second side of the floatable unit, said strap being adapted to control the floatable unit in a transverse direction in relation to the vessel, and said back springs and said strap being connected to the vessel.

Advantageously at least two mooring lines may be arranged, said mooring lines are in connection with the strap and the back spring, respectively. And between the mooring lines and the strap and/or between the mooring lines and the back springs there may be arranged at least one flexible element.

Finally, the present invention also concerns the use of a mooring system for a floatable unit, such as liferaft or platform, said floatable unit having a first side facing a vessel side and a second side facing away from the vessel side, the mooring system comprises at least two back springs which are in connection with the first side of the floatable unit, said back springs being adapted to control the floatable unit in a longitudinal direction in relation to the vessel, at least one strap which is in connection with the second side of the floatable unit, said strap being adapted to control the floatable unit in a transverse direction in relation to the vessel, and said back springs and said strap being connected to the vessel.

BRIEF DESCRIPTION OF THE DRAWINGS

The invention and its advantages will be described in more detail below with reference to the accompanying schematic drawings, which by way of example illustrate currently preferred embodiments of the invention.

All the figures are highly schematic and not necessarily to scale, and they show only parts which are necessary in order to elucidate the invention, other parts being omitted or merely suggested.

DESCRIPTION OF PREFERRED EMBODIMENTS

In the shown example the evacuation of the passengers or crew members takes place from the vessel by means of a chute, the evacuation from the vessel into the raft is independent of the mooring system, and may thus take place by means of a slide, a rope, ladders, jumps or in other ways.

The mooring system will be described in an embodiment, which in no way shall be considered as limiting for the invention.

Figure 1:
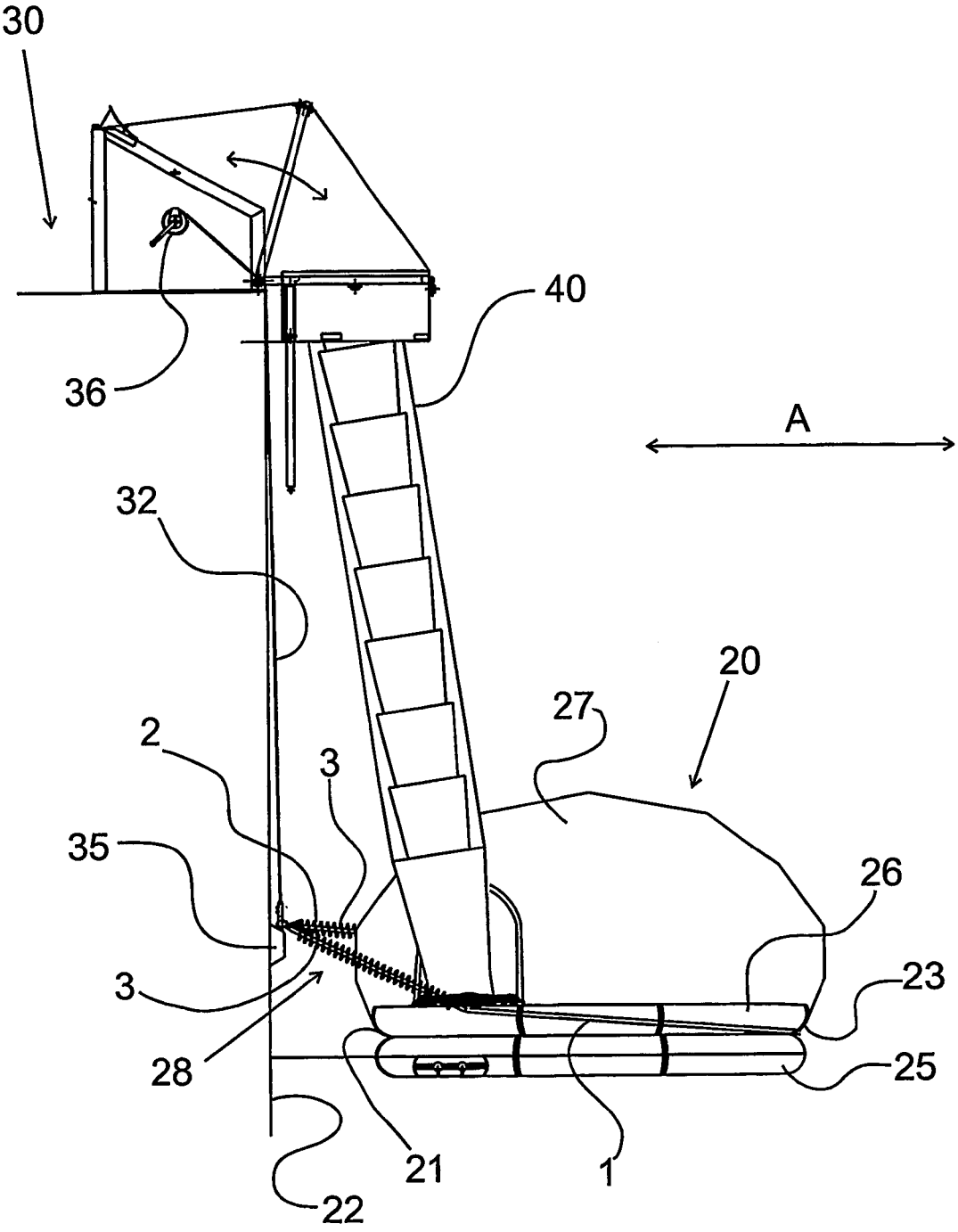
FIG. 1 shows in a side view an embodiment of the mooring system according to the invention.

In FIG. 1 the floatable unit 20 is shown, here in the form of an inflatable liferaft. According to the invention the floatable unit may also be a platform or a MOB-boat (man over board).

The floatable unit 20 has a first side 21 facing a vessel side 22 and a second side 23 facing away from the vessel side 22. The inflatable floatable unit 20 furthermore comprises a peripheral edge having two inflatable chambers 25, 26 surrounding a bottom (not shown) secured in leak tight fashion to the tubular inflatable chambers. The floating unit 20 also comprises a canopy 27, so as to provide shelter for the evacuated persons.

A mooring system 28 having at least two back springs 2 which are in connection with the first side 21 of the floatable unit 20, said back springs 2 being adapted to control the floatable unit 20 in a longitudinal direction in relation to the vessel 30.

Furthermore, the mooring system 28 comprises at least one strap 1 which is in connection with the second side 23 of the floatable unit 20, said strap 1 being adapted to control the floatable unit 20 in a transverse direction (arrow A) in relation to the vessel 30. The back springs 2 and the strap 1 are connected to the vessel 30 via mooring line 32.

In connection with the strap 1 a flexible element 3 is arranged and in connection with the back springs 2 a flexible element 3 is also arranged for absorbing the tensile stresses in the strap 1 and the back springs 2.

The mooring line 32 is connected to the strap 1 and the back springs 2 via guiding point 35 placed on the vessel side 22 above the water line. The mooring line 32 is furthermore connected to a winch 36 placed on the deck of the vessel 30.

In this embodiment according to the invention as mentioned above the evacuation of the persons on the vessel 30 takes place by means of a chute 40. The function of the chute 40 is well known in the art and will therefore not be explained in further detail.

Figure 2:
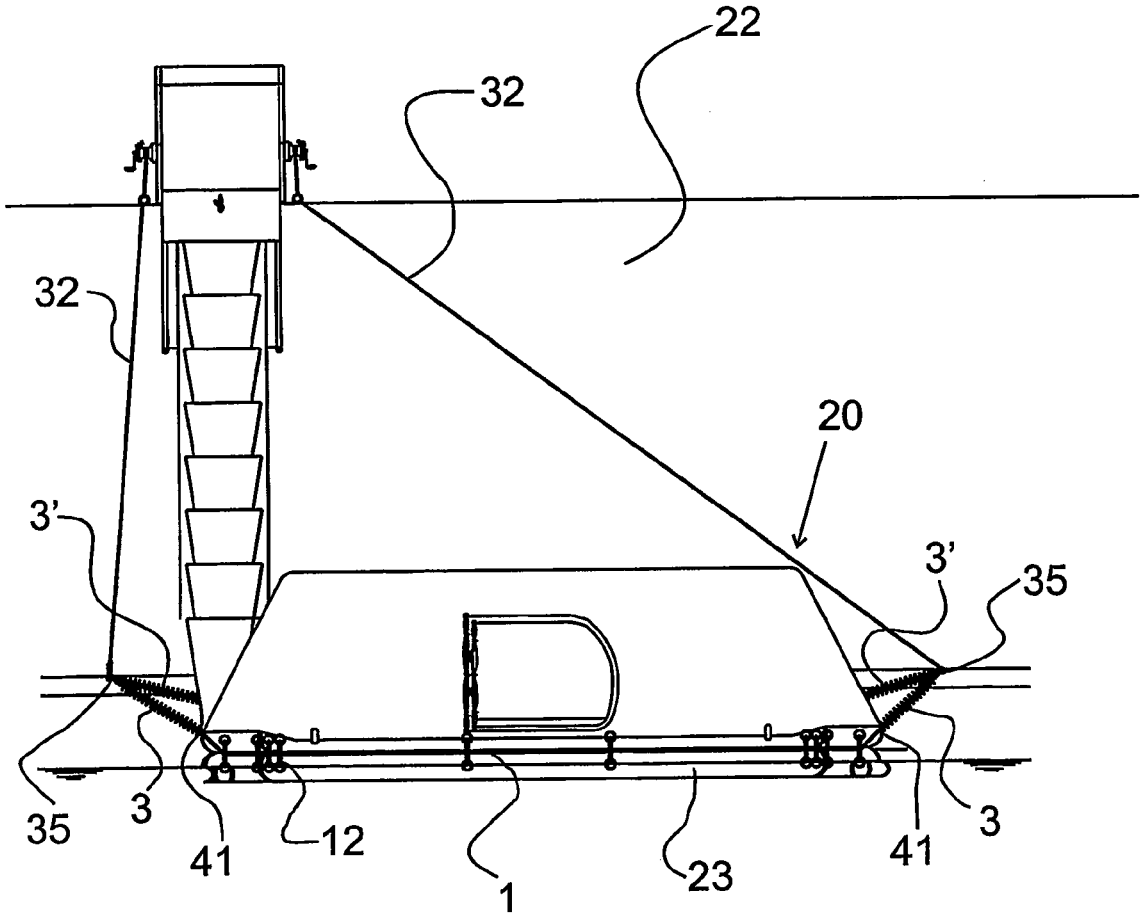
FIG. 2 shows the system of FIG. 1 seen alongside a vessel side.

FIG. 2 shows the floatable unit 20 seen alongside the vessel side 22. In this figure it is seen that the mooring system comprises two mooring lines 32, which are connected to the vessel 30.

The mooring system also consists of the strap 1, which is placed outside around the raft 20 held in position in strap attachments 12, which is placed on the side 23 of the raft 20, which is facing away from the vessel side 22 as well as on the two longitudinal sides.

The strap attachments 12 are in the shown embodiment placed so that they extend from a first chamber 26 to a second chamber 25 for distributing the forces between the two chambers and to avoid that the buoyancy chambers are separated.

The strap 1 is in its ends 41 arranged with a flexible element 3, which in the shown embodiment is a thick elastic rope, which is wrapped with ropes. The ropes shall function as a stop rope, which secures that the elastic is not burst. The strap 1 and the flexible element 3 is connected to each other through a P-joint 4. The flexible element 3 will be explained more detailed below.

The back springs can in this embodiment not be seen. However, in relation to the ends of the back springs further flexible elements 3' are arranged. The flexible elements 3' of the back springs and the flexible elements 3 of the strap 1 are connected to the mooring lines 32, which are lead to the vessel by means of the guiding points 35. The guiding points 35 are in expedient manner placed in mutual distance greater than the length of the floatable unit 20, whereby a secure way of holding the floatable unit 20 in position is obtained.

Figure 3:
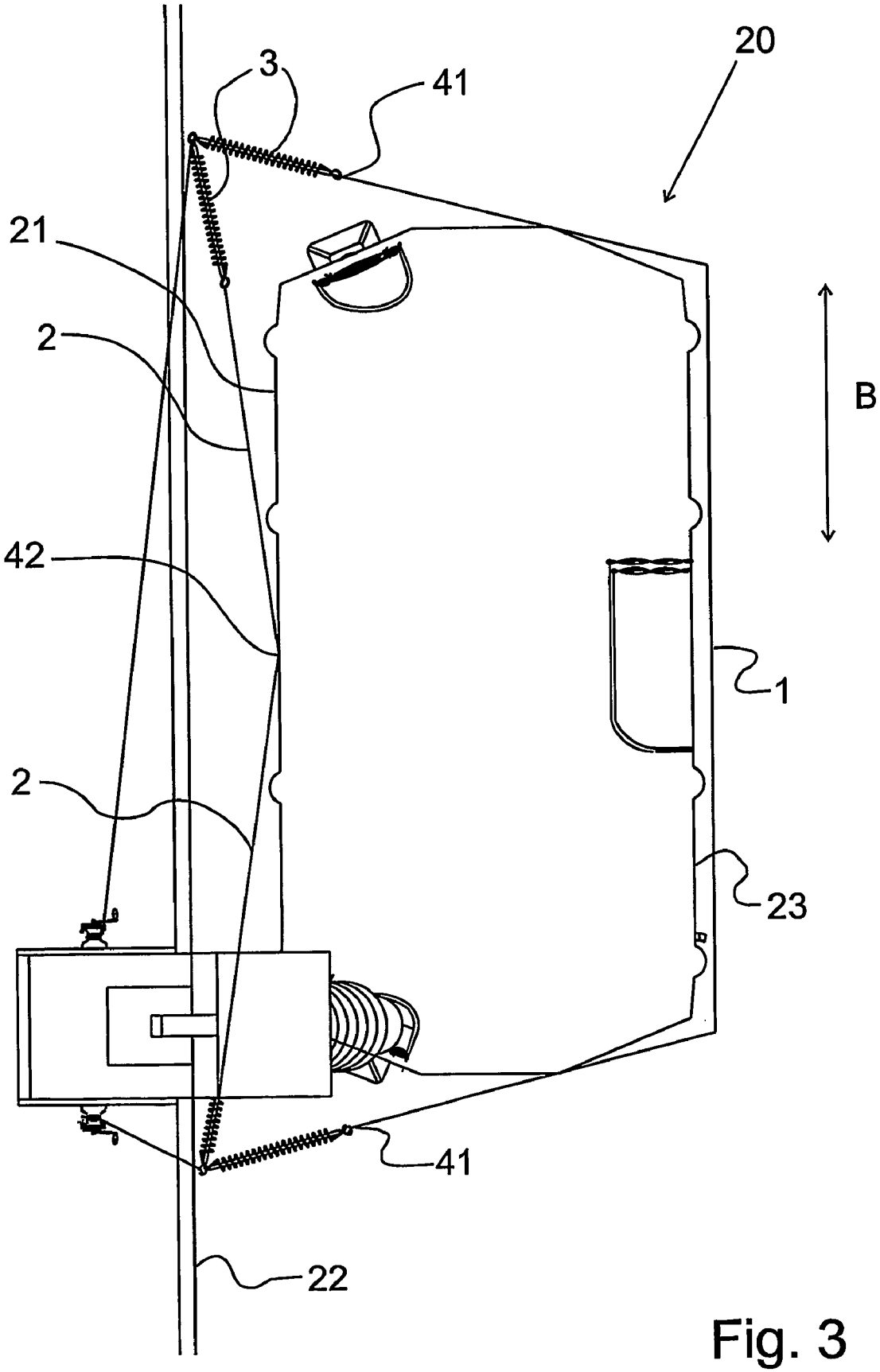
FIG. 3 shows the system according to FIGS. 1 and 2 seen from above.

FIG. 3 shows the floatable unit 20 from above. The strap 1 is lead alongside the second side 23 of the floatable unit 20, so as to provide an encircling of the floatable unit 20, and each end 41 of the strap 1 is connected to the vessel.

This encircling or wrapping of the floatable unit 20 provides a secure way to hold the floatable unit 20 in a fixed position. Furthermore, the pulling forces exerted on the strap 1 may be absorbed by the entire second side 23 of the floatable unit 20. The fact is that the exerted forces absorbed by the strap 1 is pushing the floatable unit against the vessel, rather than as the prior art pulling the strap 1 away from the floatable unit 20, with the result of damaging the attachment.

Furthermore the mooring system consists of two back springs 2, which absorb the movements of the raft alongside the vessel side 22. The back springs 2 are in the shown embodiment arranged at the centre 42 of the raft 20 on the side 21 of the raft 20, which are facing the vessel side 22. The back springs 2 being adapted to control the floatable unit 20 in a longitudinal direction (arrow B) in relation to the vessel 30.

The floatable unit 20 is in this embodiment shown substantially as having four sides. However, the floatable may inside the inventive concept have many different designs or shapes, such as for instance round or have a plurality of sides.

Figure 4:
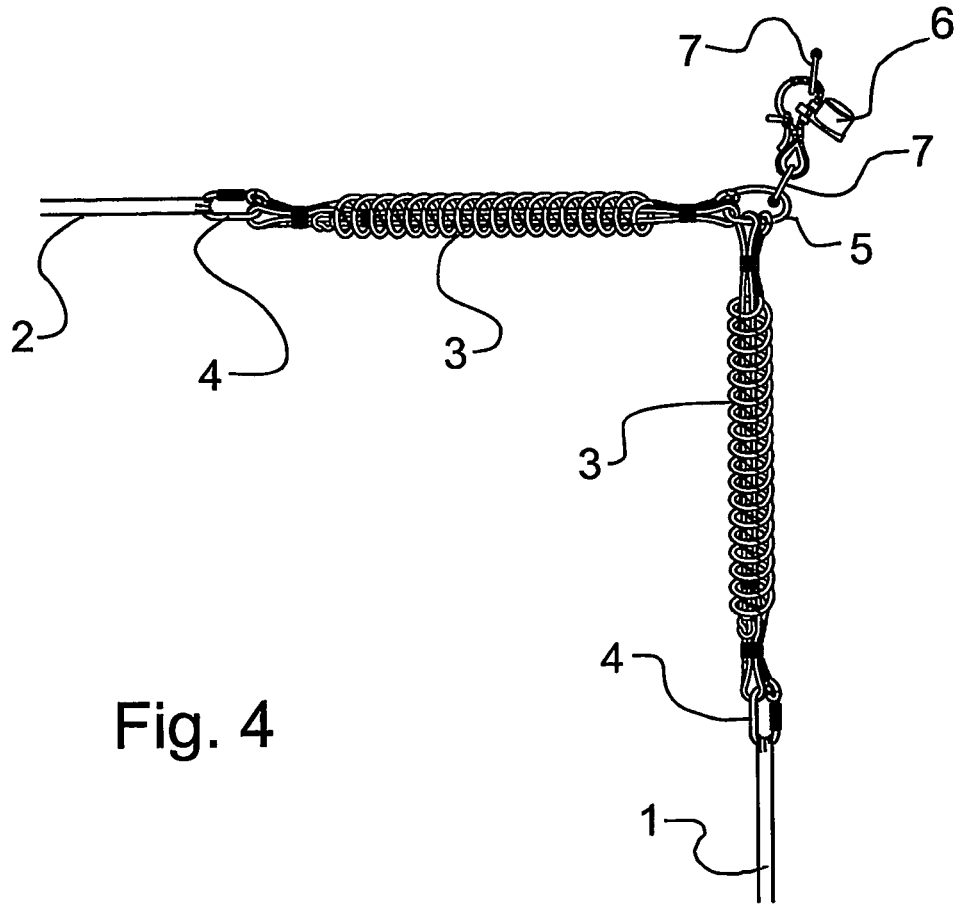
FIG. 4 shows in detail a first embodiment of the flexible element according to the invention.

In FIG. 4 an embodiment of the flexible element 3 according to the invention is shown. The flexible elements 3, which extends from the strap 1 and the back spring 2, respectively, are assembled in an O-ring 5. Between the O-ring 5 and the mooring lines is a relay 6, which cuts the lines between the vessel and the raft in case the vessel is sinking arranged by means of a shackle 7.

The relay may for instance be a Hydrostatic release unit, which is adapted to automatically make the liferafts container float free when the release unit reaches a dept of water of for example 2–4 meters. If the vessel sinks, the water pressure will activate a sharp knife that cuts the strong rope and the floatable unit will float free. The relay is in this embodiment placed at the assembly of the mooring lines and the strap and back springs, but could also be arranged in other places in the floatable unit, which will be appreciated by the skilled person.

The back springs 2 are, in the same manner as the strap 1, at their ends arranged with a flexible element 3, which in the shown embodiment is a thick elastic rope, which is wrapped by a rope. The rope shall function as a stop rope which secures that the elastic does not burst. The back spring 2 and the flexible element 3 are connected to each other through a P-joint 4.

Figure 5:
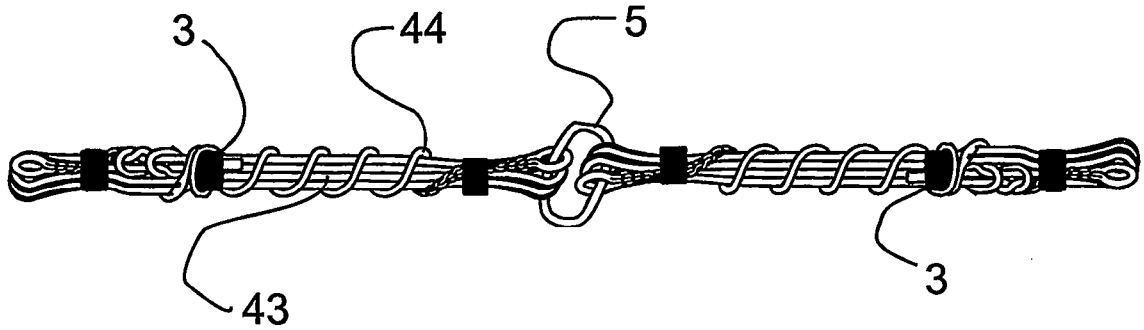
FIG. 5 shows in detail a second embodiment of the flexible element according to the invention.

FIG. 5 shows another embodiment of the flexible element 3, wherein a heavy rubber band or rope 43 makes the element elastic and in the same way as explained above in relation to FIG. 4, is the band wrapped by a stop rope 44.

Figure 6:
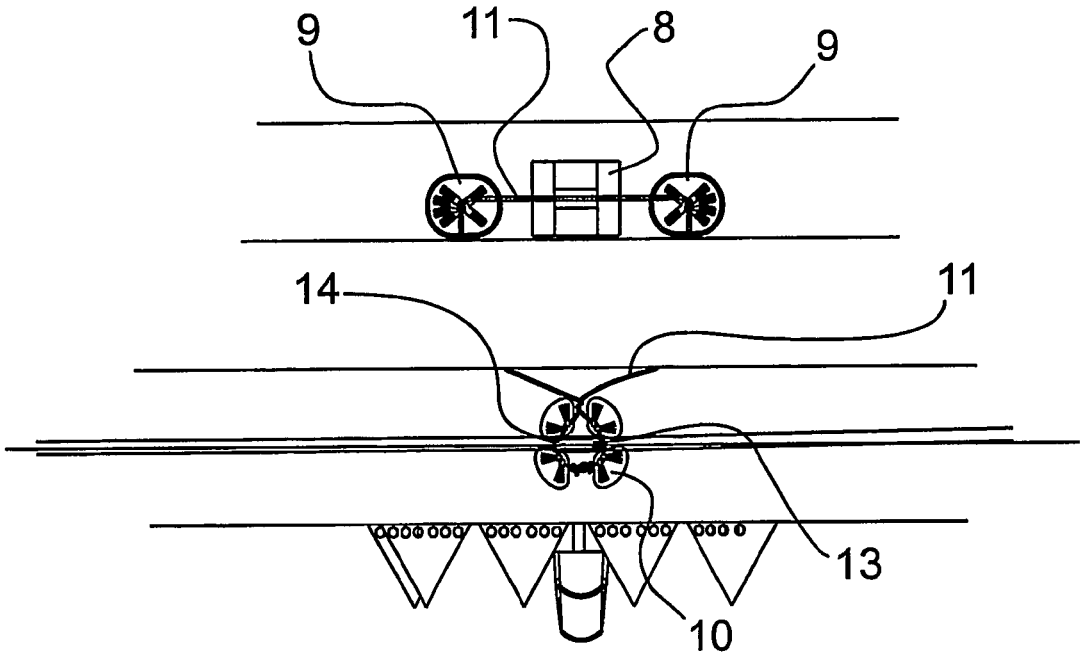
FIG. 6 shows in detail an embodiment of some attachments according to the invention.

In FIG. 6 an embodiment of the back springs attachment is shown. The back springs are fixed in a four-leaf clover attachment 10, the attachment 10 is mutually connected by the rope 11 as shown in FIG. 6, the back springs are connected to this rope 11 on the line distance 13 and 14, respectively. The four-leaf clover attachment 10 is placed in such a way that it extends from the first chamber to the second chamber for distributing the pull forces between the buoyancy chambers.

As shown in FIG. 6 the rope 11 is furthermore connected through the two attachments 9, on the top side of the second chamber under the rope 11, between the two attachments 9, a cut plate 8 might be placed if deemed necessary on which it is possible to cut the raft free from the vessel without damaging the raft. The embodiment shown in FIG. 6 secures that the persons in the floatable unit can release the floatable unit from the mooring system and thereby the vessel without leaning out of or leaving the unit. Hereby it is obtained that the persons in the floatable unit do not have to work between the sides of the vessel and the floatable unit.

Figure 7:
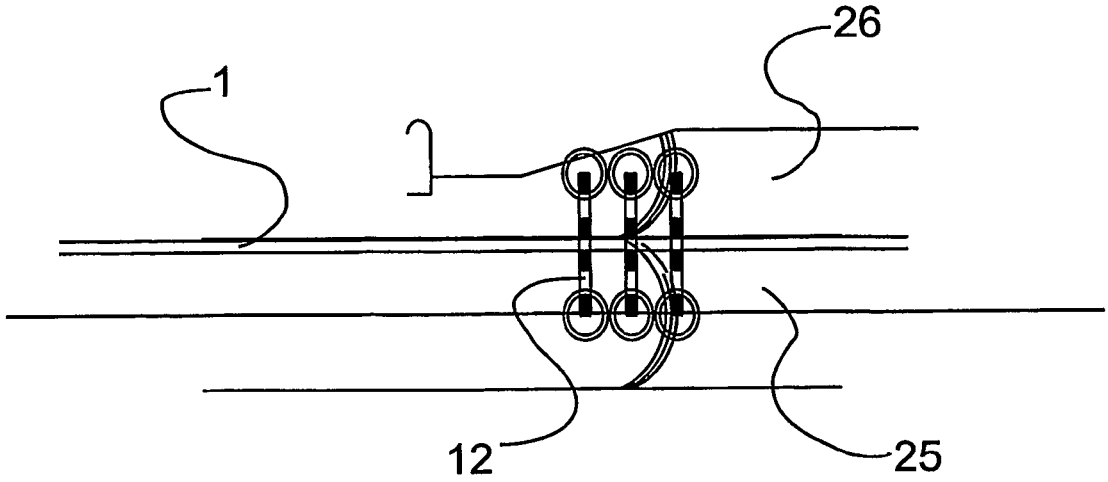
FIG. 7 shows in detail an embodiment of the strap attachments according to the invention.

FIG. 7 shows an example of the strap attachments 12 wherein the strap 1 is held in position, and in which the strap 1 is able to move sideways. The strap attachments 12 are placed so that they extend from the first chamber 26 to the second chamber 25 of the floatable unit.

In FIGS. 8*a*–8*e* the floatable unit is having a mooring system according to invention shown during operation.

Figure 8A:
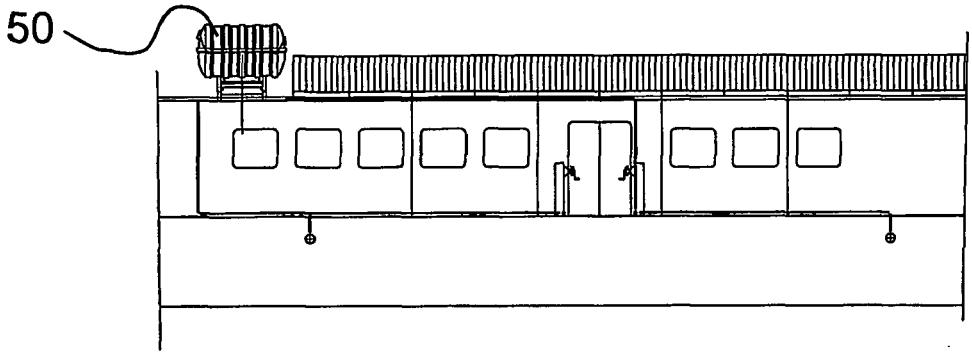
FIGS. 8*a*–8*e* shows the function of the floatable unit having a mooring system according to the invention.

In FIG. 8*a* a vessel side is shown, in this situation a container 50 containing an inflatable liferaft is not released from the vessel.

Figure 8B:
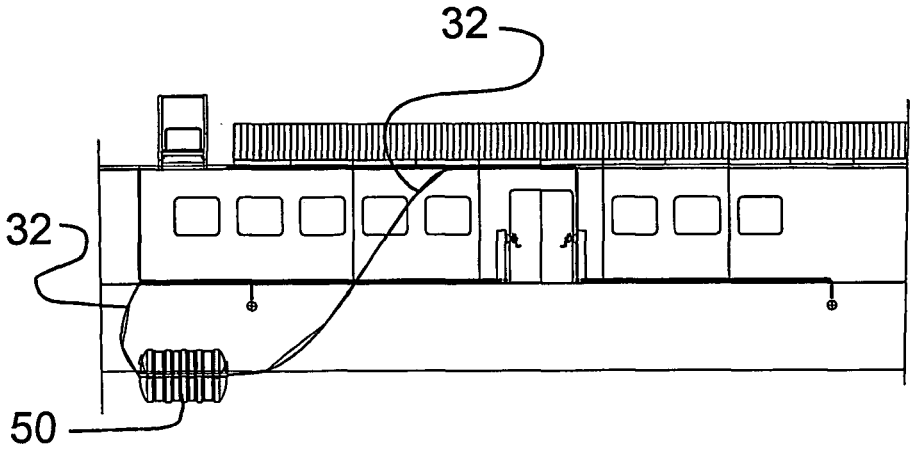

In FIG. 8*b* the container 50 is released from the vessel and floats in the water. Furthermore, it is seen that the mooring lines are being released from their attachments on the vessel side.

Figure 8C:
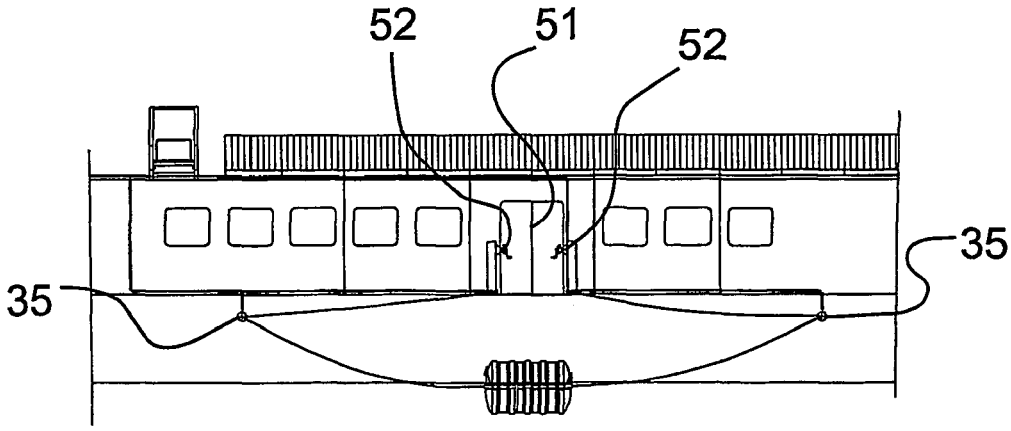

In FIG. 8*c* the container 50 is brought in position below the entering place 51 on the vessel. The mooring lines 32 are now completely released from their attachments and are from the two winches 52 connected to the container 50 via guiding points 35.

Figure 8D:
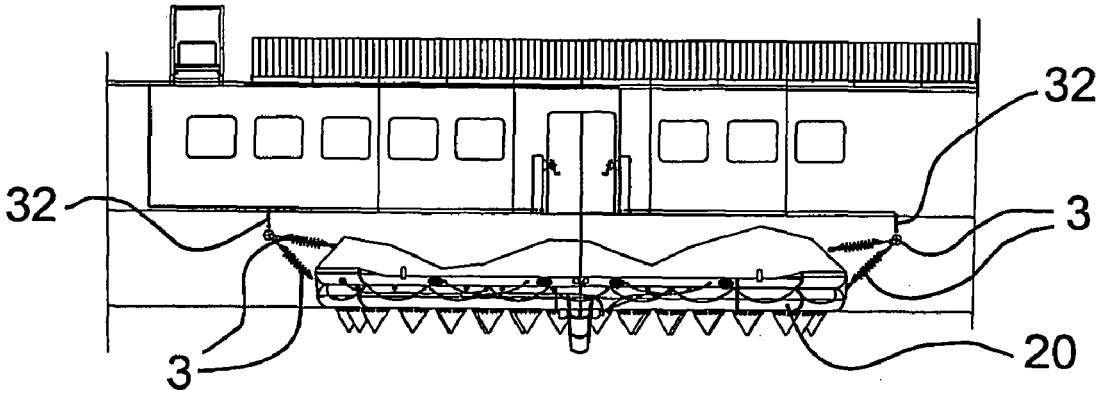

In FIG. 8*d* the liferaft 20 is contained in the container being inflated. Furthermore, the mooring lines 32 are being connected to flexible elements 3 which according to the inventive idea are arranged at the ends of the back springs and the strap. Hereby the liferaft is being held in position below the entering point.

Figure 8E:
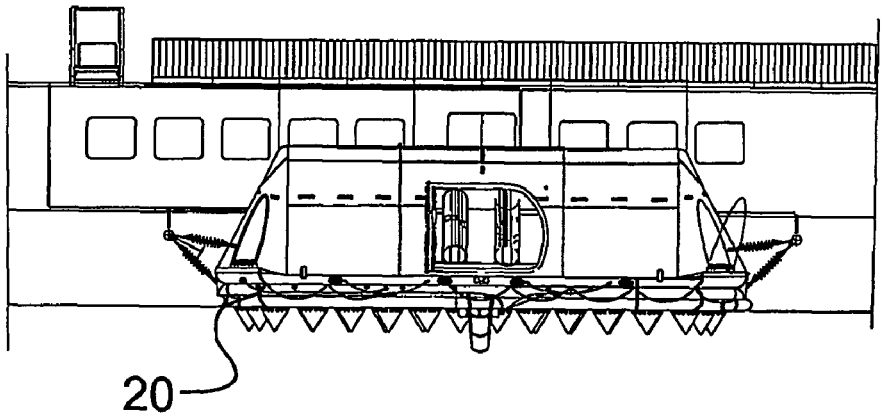

In FIG. 8*e* the liferaft is completely inflated and ready to be entered by the persons, who are to be evacuated from the vessel.

By using the mooring system according to the invention for a floatable unit, such as a liferaft it is obtained that the liferaft during use can be held in a secure and fixed position and thereby minimise the discomfort for persons being in and working on the liferaft during mooring to the vessel. A further advantage by using the inventive mooring system is that the high pulling forces which are exerted on the liferaft, especially via the transverse movements, do not damage the strap attachments by pulling them of.

Although the invention above has been described in connection with preferred embodiments of the invention, it will be evident for a person skilled in the art that several modifications are conceivable without departing from the invention as defined by the following claims.

The invention claimed is:

1. A floatable unit having a first side facing a side of a vessel and a second side facing away from the side of the vessel, said floatable unit comprising a mooring system, wherein the mooring system comprises:

two back springs which are in connection with the first side of the floatable unit, said two back springs being adapted to control the floatable unit in a longitudinal direction in relation to the vessel; and a strap which is in connection with the second side of the floatable unit, said strap being adapted to control the floatable unit in a transverse direction in relation to the vessel, and said two back springs and said strap being connected to the vessel.

2. A floatable unit according to claim 1, wherein the mooring system comprises two mooring lines which are in connection with the strap and the two back springs, respectively, said mooring lines being connected to the vessel.

3. A floatable unit according to claim 2, wherein a flexible element is arranged between the two mooring lines and at least one of the strap and the two back springs.

4. A floatable unit according to claim 2, wherein the strap has ends and the two back springs have ends, the flexible unit further comprising:

a flexible element arranged in at least one of the ends of the two back springs and/or the ends of the strap facing the vessel.

5. A floatable unit according to claim 1, wherein the strap is lead alongside the second side of the floatable unit to encircle the floatable unit, the strap having ends and each of the ends of the strap is connected to the vessel.

6. A floatable unit according to claim 1, wherein the strap is a first strap having first and second ends, the mooring system further including a second strap having first and second ends first ends of the first and second straps being fixed to the second side of the floatable unit and the second ends of the first and second straps being connected to the vessel.

7. A floatable unit according to claim 1, wherein the two back springs are fixed substantially to a center of the first side and extends outward towards the vessel.

8. A floatable unit according to claim 1, wherein the strap is held in position on the second side of the floatable unit by strap attachments, in which the strap is moveable sideways.

9. A floatable unit according claim 8, wherein the strap attachments extends from a first inflatable chamber to a second inflatable chamber of the floatable unit.

10. A floatable unit according to claim 1, wherein the floatable unit is inflatable, and the floatable unit comprises at least two inflatable chambers arranged vertically.

11. A mooring system for a floatable unit, said floatable unit having a first side facing a side of a vessel and a second side facing away from the side of the vessel wherein, the mooring system comprises:

two back springs which are in connection with the first side of the floatable unit, said two back springs being adapted to control the floatable unit in a longitudinal direction in relation to the vessel; and a strap which is in connection with the second side of the floatable unit, said strap being adapted to control the floatable unit in a transverse direction in relation to the vessel, and said two back springs and said strap being connected to the vessel.

12. A mooring system according to claim 11, further comprising two mooring lines in connection with the strap and the two back springs, respectively.

13. A mooring system according to claim 12, further comprising a flexible element arranged between the two mooring lines and at least one of the strap and the two back springs.

14. A mooring system for a floatable unit, said floatable unit having a first side facing a side of a vessel and a second side facing away from the side of the vessel, the mooring system comprising:

two back springs in connection with the first side of the floatable unit, said two back springs being adapted to control the floatable unit in a longitudinal direction in relation to the vessel; and a strap being connected to the second side of the floatable unit, and being adapted to control the floatable unit in a transverse direction in relation to the vessel, the two back springs and said strap being connected to the vessel.

* * * * *